US007481394B2

(12) United States Patent
Gleason

(10) Patent No.: US 7,481,394 B2
(45) Date of Patent: Jan. 27, 2009

(54) WIRE SPOOL CADDY

(76) Inventor: John T. Gleason, 1550 E. Burnett St., Signal Hill, CA (US) 90806

( * ) Notice: Subject to any disclaimer, the term of this patent is extended or adjusted under 35 U.S.C. 154(b) by 50 days.

(21) Appl. No.: 11/715,816

(22) Filed: Mar. 7, 2007

(65) Prior Publication Data

US 2007/0295846 A1 Dec. 27, 2007

Related U.S. Application Data

(60) Provisional application No. 60/780,451, filed on Mar. 7, 2006.

(51) Int. Cl.
*B65H 16/02* (2006.01)

(52) U.S. Cl. ..... 242/594.2; 242/594.3; 242/588

(58) Field of Classification Search ..... 242/136, 242/403.1, 404, 588, 588.1–588.3, 591, 592, 242/594.1–594.3
See application file for complete search history.

(56) References Cited

U.S. PATENT DOCUMENTS 3,856,230 A * 12/1974 Zimmer ..... 242/422.8
5,634,610 A 6/1997 Walsh
5,687,928 A * 11/1997 Lassiter ..... 242/557
5,842,662 A * 12/1998 Crossman ..... 242/422.4
5,967,451 A * 10/1999 Radaios ..... 242/594.2
6,523,777 B2 * 2/2003 Gaudio ..... 242/595.1
2005/0145748 A1 * 7/2005 Anderson et al. ..... 242/588
2007/0120003 A1 * 5/2007 Grant ..... 242/557

* cited by examiner

*Primary Examiner*—Sang Kim
(74) *Attorney, Agent, or Firm*—Law Officed Philip H. Haymond

(57) ABSTRACT

A caddy for carrying spools such as those for electrical wire. The caddy has complementary T-shaped slots in opposite side walls and members affixed between the side wall that support the spools, forming a cage, and one member rides within the T-shaped slot. The moving member may be pulled away from the cage to allow for room to release a spool from its cage, but the member will move by itself in response to movement of the caddy to keep the spool or spools locked within the cage.

18 Claims, 15 Drawing Sheets

WIRE SPOOL CADDY

RELATED APPLICATIONS

This application hereby incorporates by reference and claims the priority and filing date of U.S. provisional patent application Ser. No. 60/780,451, Inventor, filed Mar. 7, 2006 and entitled WIRE SPOOL CADDY.

COPYRIGHT INTEREST

A portion of the disclosure of this patent document contains material which is subject to copyright protection. The copyright owner has no objection to the facsimile reproduction by anyone of the patent document or the patent disclosure, as it appears in the U.S. Patent and Trademark Office patent file or records, but otherwise reserves all copyright rights whatsoever.

FIELD OF THE INVENTION

This invention relates to storage devices for wire and more particularly to a spool caddy for storing spools of wire for ready use.

BACKGROUND OF THE INVENTION

A number of devices such as racks and caddies for holding wire spools are found in the prior art. Most incorporate an axle where the spool is retained on that axle. This configuration causes a problem however during use when wire slackens and moves over the side of a reel. The wire will then snag on the axle or even a neighboring spool, requiring a user to disassemble the caddy to remove the individual spool and rewind it.

A few device configurations of the prior art attempt to solve this problem by providing external rods or other members confining one or more spools of wire. With this design when the wire inadvertently moves over the side of a spool it falls harmlessly to the side. The wire then needs to only be drawn taught and the spool wound to draw the slack back inwards. Riplinger, U.S. Pat. No. 4,896,863, Walsh U.S. Pat. No. 5,634,610 and Gaudio U.S. Pat. No. 6,523,777 are patents disclosing devices of this general configuration.

Several problems arise with some of these spool caddies of the prior art. If there are insufficient numbers of external members cradling the individual spools, the wire has a greater opportunity to move over the side of the spool. The external members themselves act as a stop against the wire movement off the side of the spool.

Another problem is the act of inserting the wire spool within the external members themselves. Devices of the prior art provide cumbersome mechanisms to add, remove or service the wire spools within a caddy. For example where an external member must be hinged to remove it outwards to allow access to the zone surrounded by the external members. The caddy might have to be held in an upright position to allow access to this zone, much like a cabinet. Another design requires springs to hold the external members in place and is requires difficult maneuvering to extract and insert spools.

In practice these devices can become intolerably difficult to use when an electrician is moving the caddy around in the field. The caddy is moved in different orientations and it would be desirable to have a caddy that can maintain the spools and easy access to them in any orientation, all while the external members maintain a sufficient grasp on the spools to retain them. Those spools of the prior art that must be maintained in a single orientation in order to function are difficult to use when an electrician is moving from place to place in the field.

Another problem is the ability to move the caddy about. It is desirable to have a heavy spool caddy transportable that can be alternately dragged or carried about a work site. The carrying of a heavy spool caddy is an orthopedic strain on the user, possibly leading to injury.

Yet another problem is the limited capacity of spool caddies. A user may need a wide variety of different sizes of wire, each on a different spool, during the course of a given job.

SUMMARY OF THE INVENTION

Figure 1A:
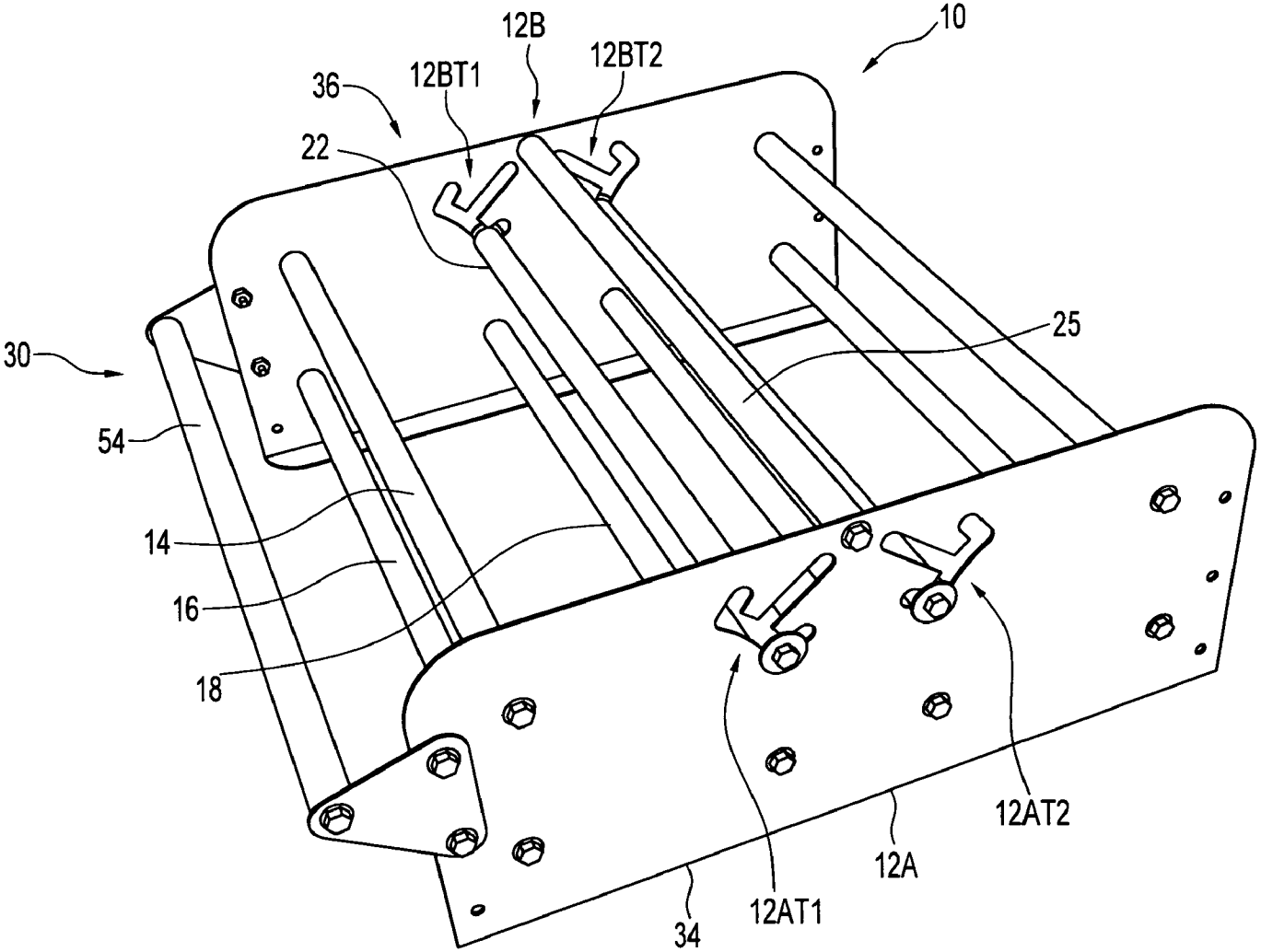
FIG. 1A is a perspective view from a side and top of the present invention, an electrical wire spool caddy.

A spool caddy having a unique T-shaped locking mechanism is provided, the mechanism is used to both gain access to a zone bounded by external members supporting individual wire spools, as well as to keep external spool-holding members locked about one or more spools when the caddy is at many orientations; the locking action is actuated by gravity depending on the orientation of the caddy.

The spool caddy is comprised of two side walls held at a fixed relative orientation by members fixedly attached to each wall. Members are provided to form three roller surfaces to support the spool walls of a spool of wire. Complementary T-shaped slots are formed in opposite side walls and a locking member is fitted with end stops at each end to move within the T-shaped slots of side walls, moving freely within these slots.

In the preferred embodiment an additional structurally reinforcing member is fixedly attached to each wall between the T-shaped slots to reinforce the side walls. A flange may be formed on the rear side of the caddy on each wall at a ninety-degree angle to each wall, bent inwardly towards the opposite wall, to further reinforce the side walls.

In the preferred embodiment the members are rod-shaped, preferably hollow tubes to reduce the overall weight of the caddy, acting as rollers to support spools of wire. The members may also be covered with tube coverings or covering segments to allow the tubing to roll over the tube and thereby decrease frictional resistance to the rotating wire spool when wire is drawn from it.

In the preferred embodiment each side wall has two such T-shaped slots, forming two sets of complementary T-shaped slots, but the present invention also encompasses providing only one set of complementary T-shaped slots. Each set of members supporting a spool of wire comprises a holding cage and each caddy of the preferred embodiment has two holding cages.

Wheels may be further affixed to the caddy at one end to allow it to be used as a cart. A handle may be affixed at the opposite end of the caddy and that handle is offset from the center of the major axis to allow the caddy to swing out when towed.

The slots of the T-shaped locking mechanism are comprised of a central release track, a perpendicular travel slot, and dog-legged locking tracks at the end of the travel slots. When the locking member is moved by a user to the central release track it creates enough room to remove a spool from a cage. When a locking roller is moved into one of either of the locking tracks under the force of gravity, the spools of wire are held securely in their cage. Members move in response to changing the orientation of the caddy to a surface, thereby keeping the spools of wire securely in their cage, while still being able to remove a spool by simply manually moving a member.

In one embodiment the caddy may also be used as a wire spool shelf, affixed at the rear side to a wall.

In the preferred embodiment a flange is formed on the rear side of each wall to allow the unit to be placed on nails or studs in a wall or other vertical surface.

The spools may be used with end caps, which allows a standardized spool diameter although multiple spools of different side diameters are being used. This standardization creates and equal distribution of weight of the members and can be used with a damaged spool as well.

In this respect, before explaining at least one embodiment of the invention in detail it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention. Additional aspects and advantages of the present invention are set forth in the following description and claims, particularly when considered in conjunction with the accompanying drawings in which like parts bear like reference numerals.

DESCRIPTION OF THE INVENTION

The following description, and the figures to which it refers, are provided for the purpose of describing examples and specific embodiments of the invention only and are not intended to exhaustively describe all possible examples and embodiments of the invention. In the following various figures identical elements and features are given the same reference number, and similar or corresponding elements and features are or may be given the same reference numbers followed by an a, b, c, and so on as appropriate for purposes of describing the various embodiments of the present invention.

A solution to the above problems has been devised. A spool caddy having a unique T-shaped locking mechanism is provided, shown generally as 12AT1 and 12BT1, and 12AT2 and 12BT2 in FIGS. 1A, 2A and 3A. The T-shaped locking mechanism is used to both gain access to the zone surrounded by external members to support the individual wire spools, as well as to keep external spool-holding members locked about one or more spools at any orientation. The locking action is actuated by gravity depending on the orientation of the caddy.

Figure 1B:
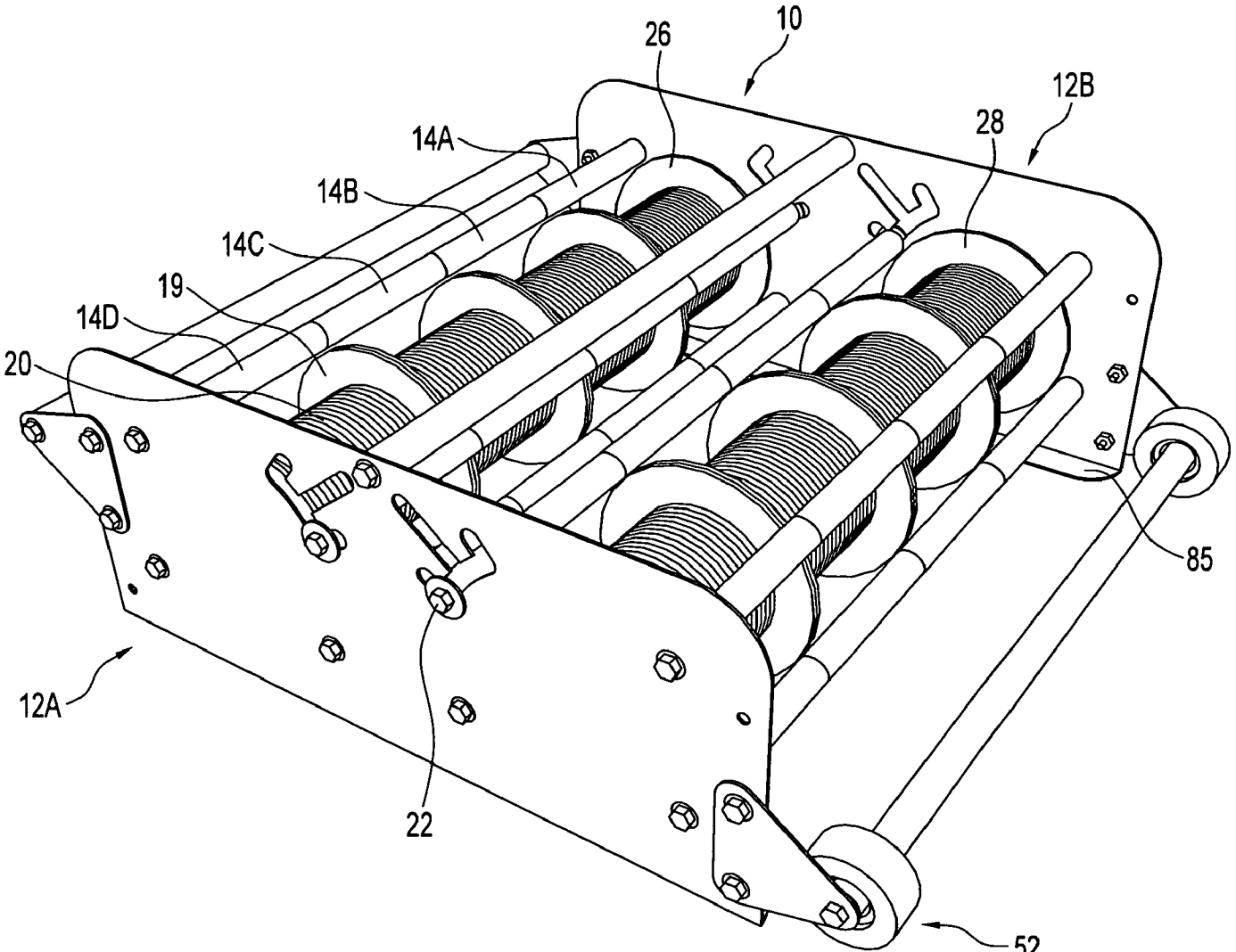
FIG. 1B is a perspective view from the side and bottom of the spool caddy.

FIGS. 1A and 1B show perspective views from the top 30, front 36 and a side wall 12A of the present invention. The spool caddy 10 is comprised of side walls 12A and 12B having first 14 second 16 and third 18 members fixedly attached to each wall, forming three roller surfaces to support the spool walls 19 of a wire spool 20. Complementary T-shaped slots 12AT1 and 12BT1, and 12AT2 and 12BT2 are formed in side walls 12A and 12B. A fourth locking member 22 is fitted with end stops 23 (not shown) at each end to move within the T-shaped slots of side walls 12A and 12B, extending between them and moving freely within these slots. The end stops may, for example, be studs retained by washers within the slots or pins retained by cotter pins.

In the preferred embodiment a fifth structurally reinforcing member 25 is also fixedly attached to each wall between the T-shaped slots to reinforce the side walls 12A and 12B. A flange 85 is formed on the rear side 34 of the caddy 10 on each wall 12A and 12B, at a ninety-degree angle to each wall 12A and 12B, inwardly towards the opposite wall, to further reinforce the side walls.

In the preferred embodiment the members 14, 16, 18, 22 and 25 are rod-shaped, preferably hollow tubes to reduce the overall weight of the caddy 10, to act as rollers. The members are covered with tube coverings 14A, 16A, 18A and 22A to allow the tubing to roll over the tube and thereby decrease frictional resistance to the rotating wire spool 20 when wire is drawn from it.

In the preferred embodiment the tube coverings 14A, 16A, 18A and 22A comprise a plurality of segments, four segments are shown at 14A1, 14A2, 14A3 and 14A4 to allow individual spools 20 to spin independently on the tube coverings 14A, 16A, 18A and 22A. The spool walls 19 of each spool 20 can counter-rotate against the tube covering segments, when wire is pulled from the spool 20, without causing neighboring spools to rotate too.

In the preferred embodiment each side wall 12A and 12B has two such T-shaped slots, forming two sets of complementary T-shaped slots, 12AT1 and 12BT1, and 12AT2 and 12BT2 formed in side walls 12A and 12B. Each set of members 14, 16, 18, 22 comprise a holding cage and each caddy of the preferred embodiment has two holding cages 26 and 28 for wire spools 20.

Figure 1C:
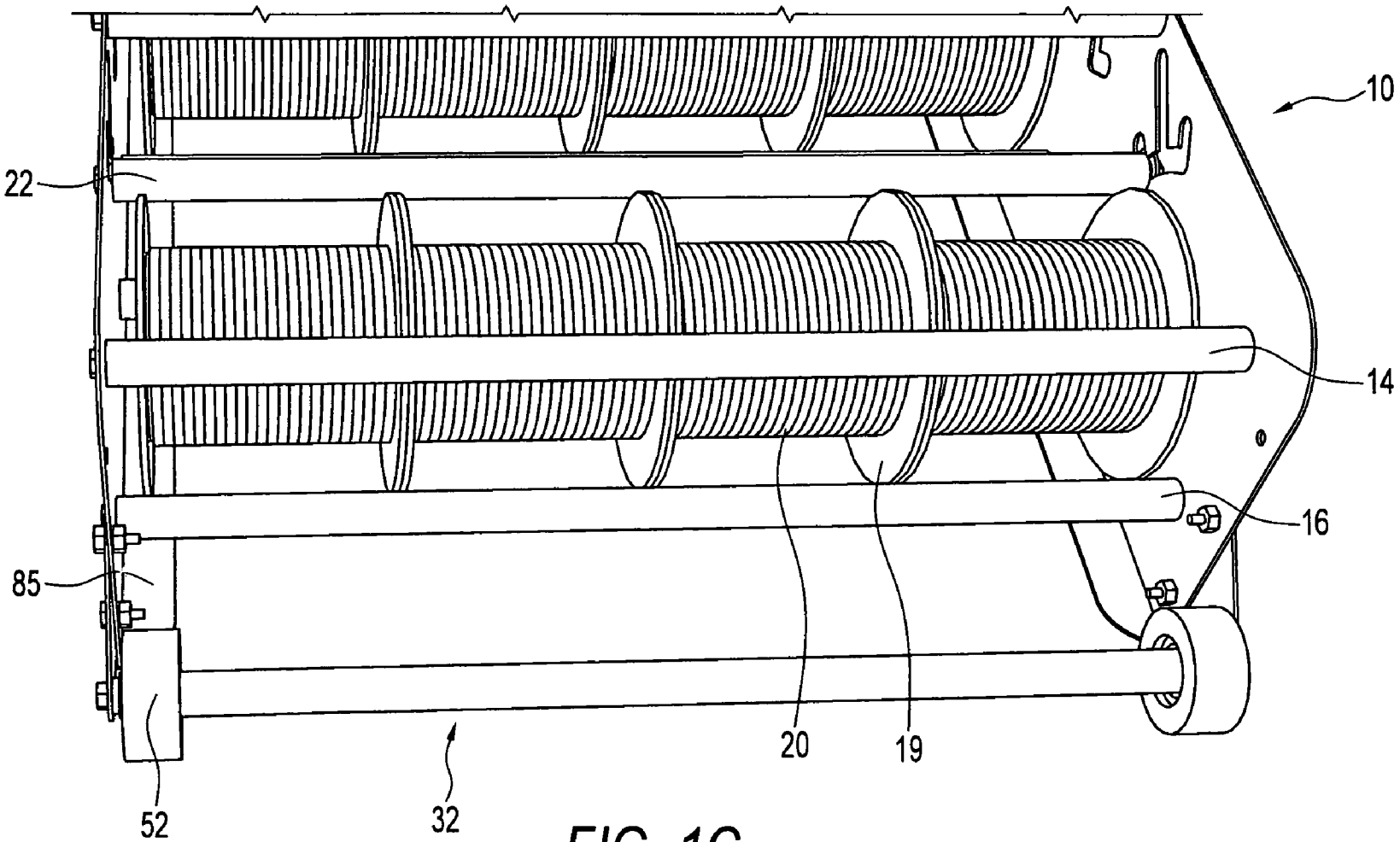
FIG. 1C is a view from the bottom of the spool caddy.

Further referring to FIG. 1C, an additional feature of the preferred embodiment is detailed. Wheels 52 are affixed to the caddy 10 at its bottom 32 to allow it to be used like a cart 50. An offset handle 54, shown in FIG. 1A, is affixed at the top end 30 of the caddy.

Figure 2A:
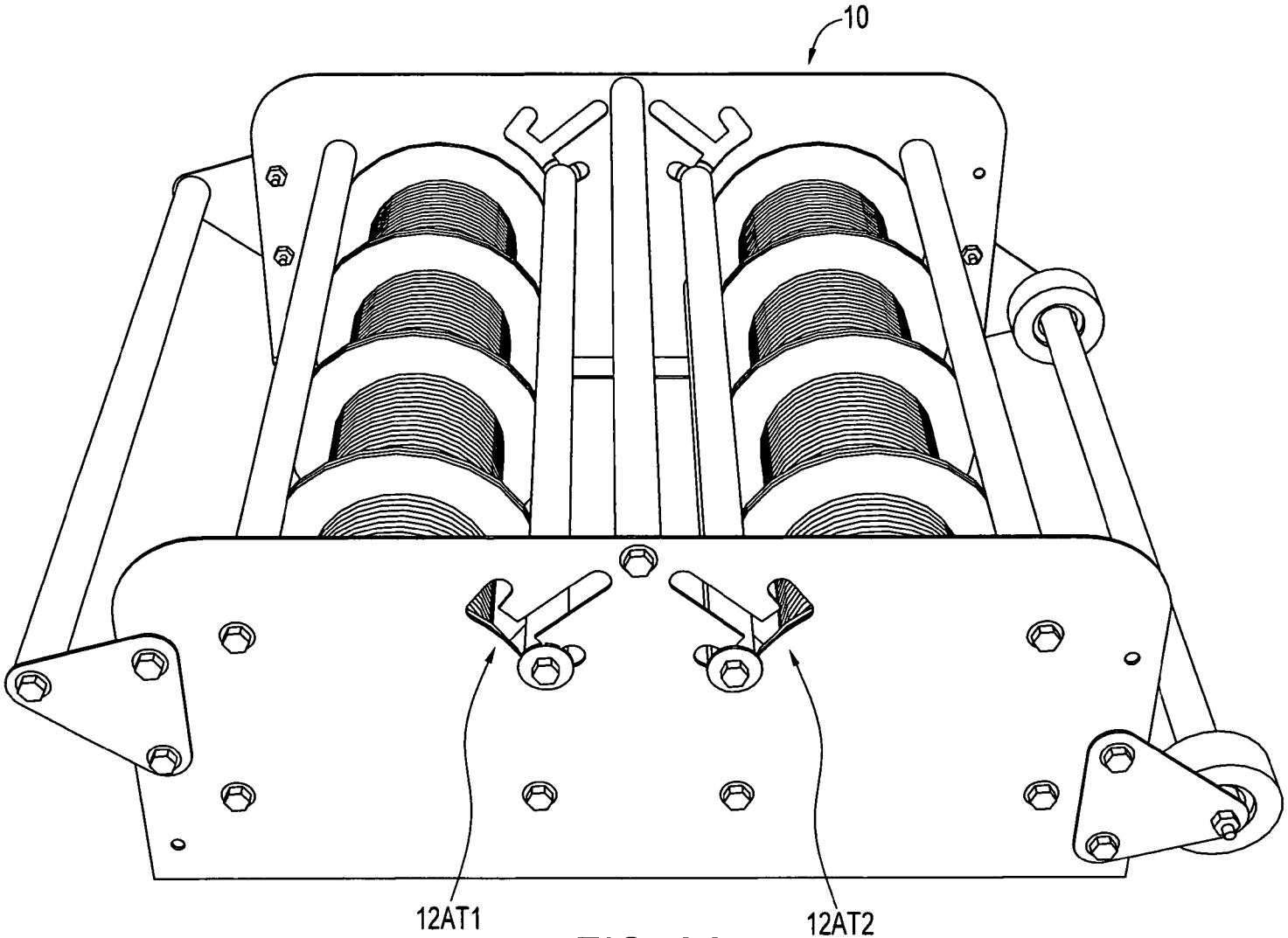
FIG. 2A is a side view from of the spool caddy.
Figure 2B:
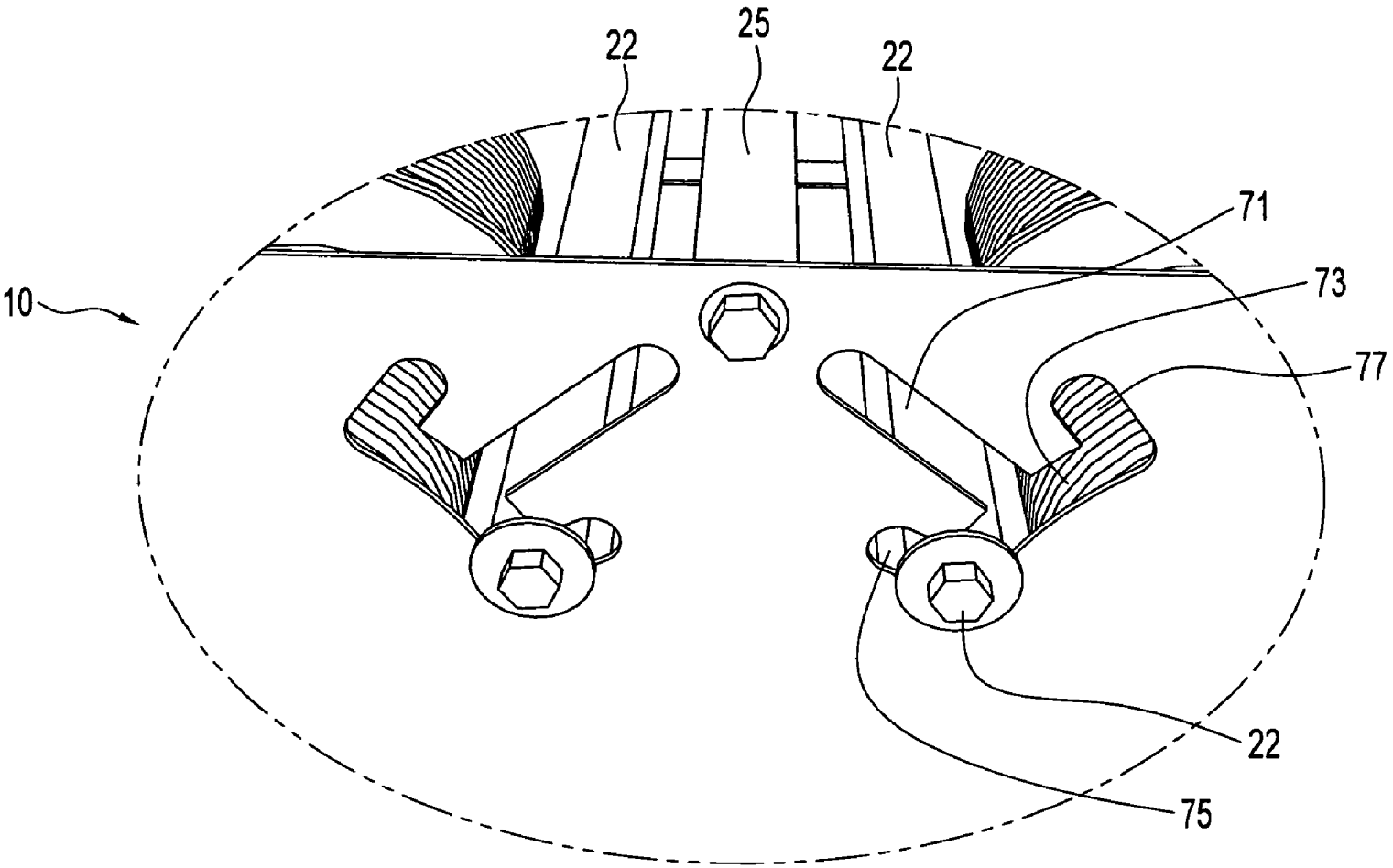
FIG. 2B is a detail view of the locking mechanism shown in FIG. 2A.

FIGS. 2A and 2B are side perspective and detail views of one side of the T-shaped locking mechanisms 12AT and 12BT of the present invention. The slots themselves are comprised of a central release track 71, a perpendicular travel slot 73 and dog-legged locking tracks 75 and 77. When the locking rollers 22 of a member 22 are moved by a user to the central release track 71 it creates enough room to remove a spool from a cage. When the of a locking roller 22 are moved into one of either of the locking tracks 75 and 77 under the force of gravity, the spools 20 are held securely in their cage. Perpendicular travel slot 73 allows the locking rollers 22 to move freely between the other tracks under the force of gravity or manually by a user.

Figure 3A:
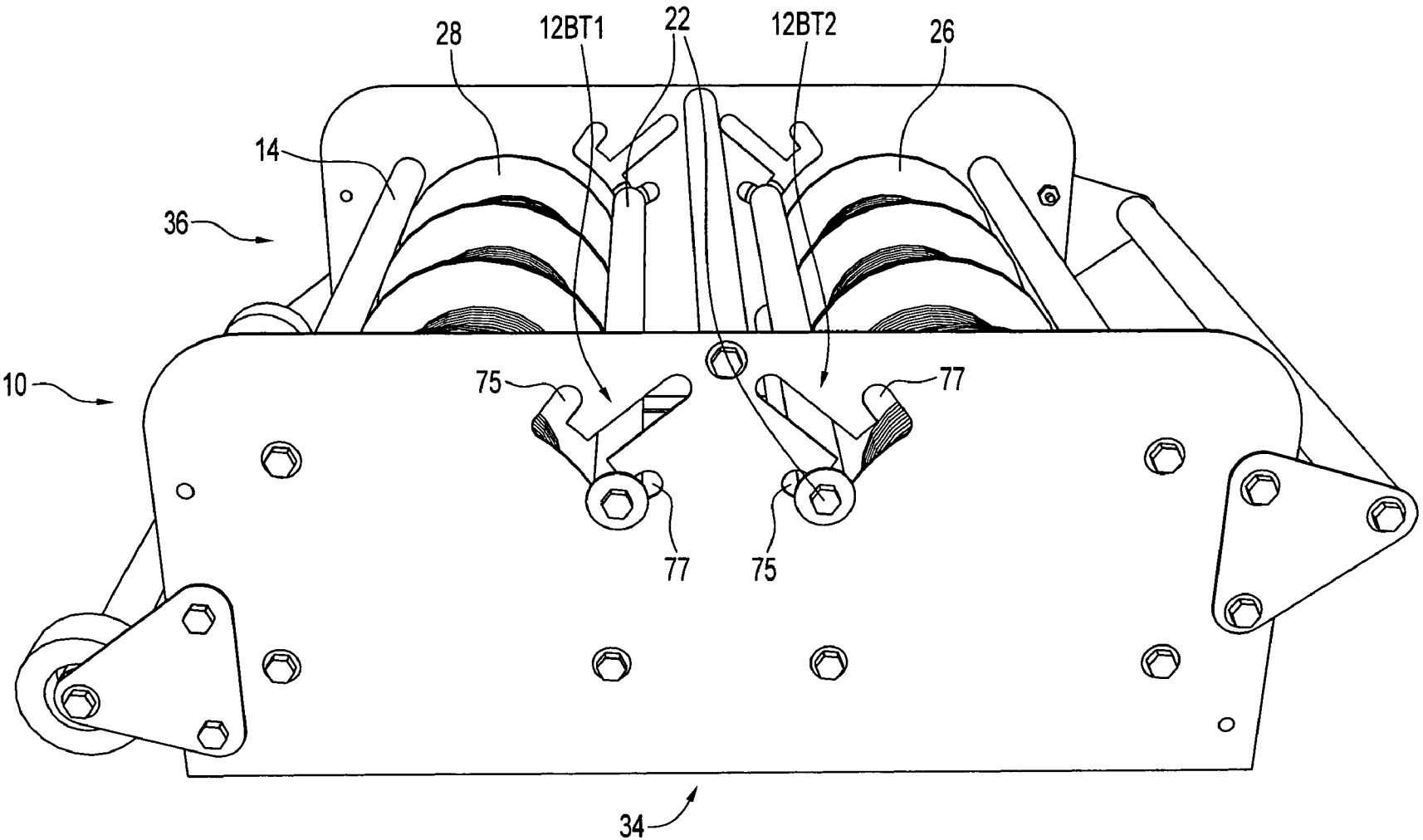
FIG. 3A is a side view of the caddy shown in a first position.
Figure 3B:
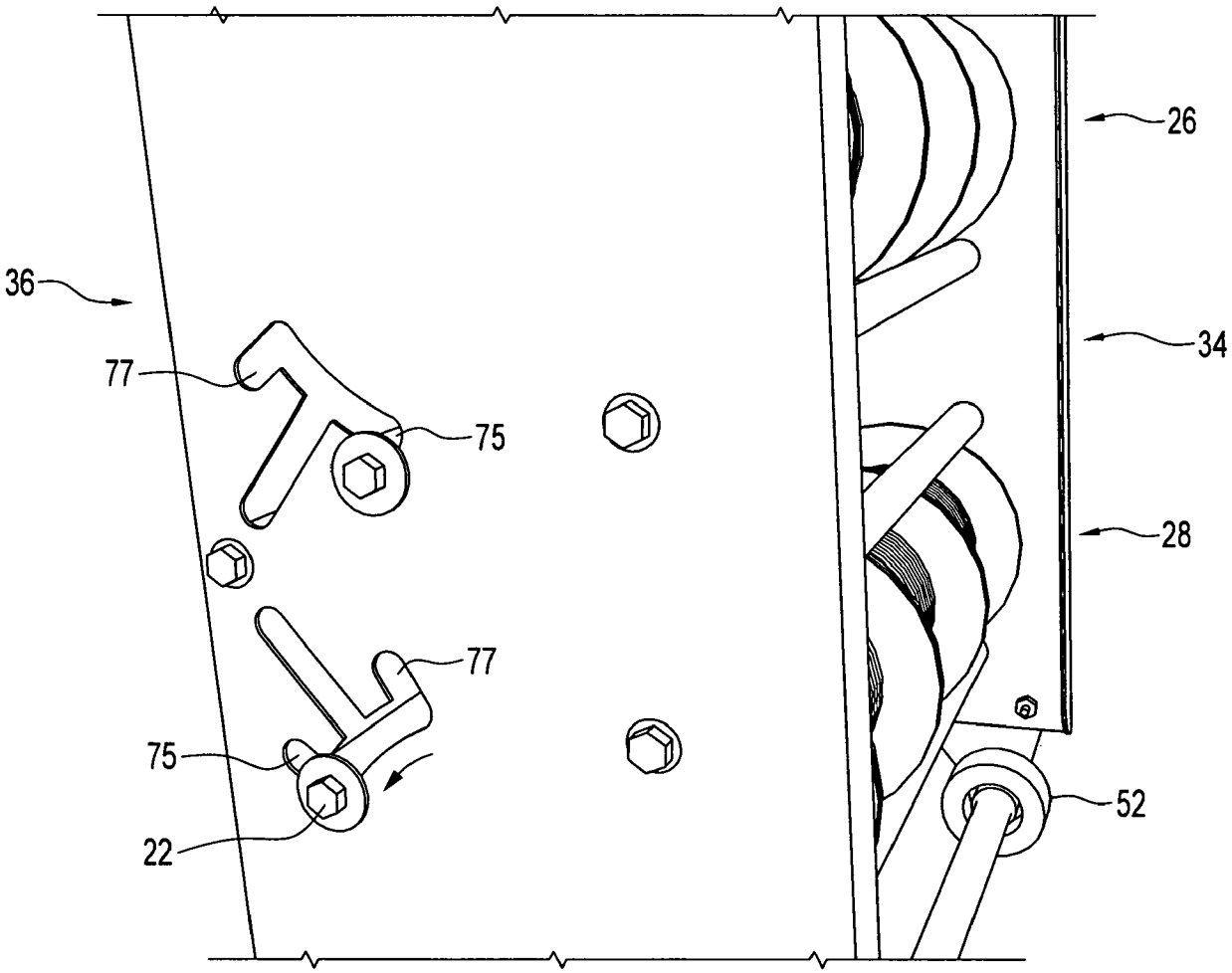
FIG. 3B is a side view of the caddy shown in a second position.
Figure 3C:
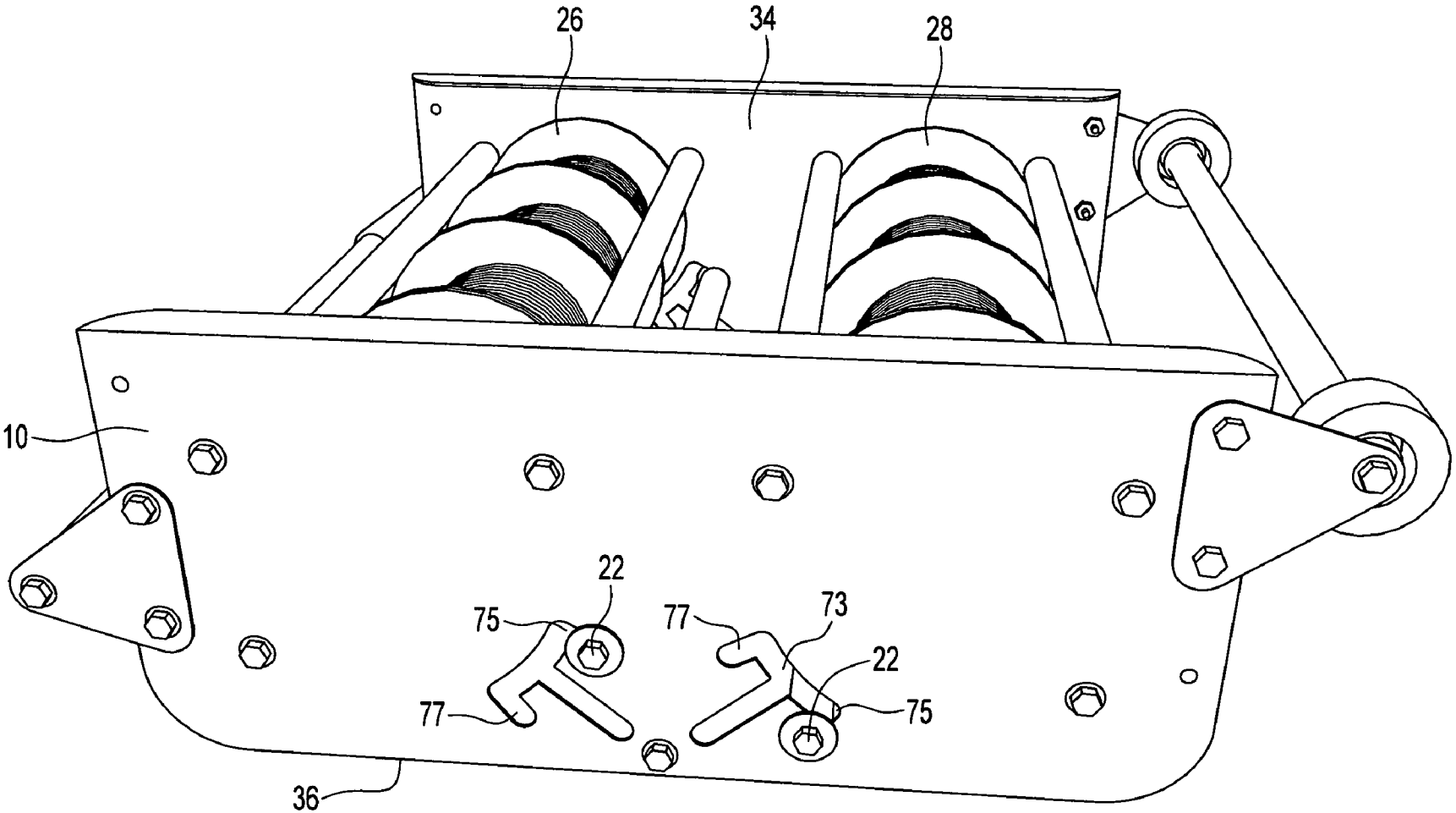
FIG. 3C is a side view of the caddy shown in a third position.

FIGS. 3A, 3B and 3C show the action of the locking members 22 as they slide through the T-shaped locking mechanisms 12AT1 and 12AT2 under the force of gravity as the caddy 10 is rotated.

In the orientation with respect to a surface of a first position of FIG. 3A, with the caddy 10 resting on its rear side 34, opposite front side 36, the spools carried in the cages 26 and 28 are secured by the three remaining members 14, 16 and 18, as well at locking member 22, with locking member 22 locked in locking tracks 77 and 75. Locking member 22 is in the first position at one end 34 of the complementary T-shaped slots 12BT1 and 12BT2.

When the caddy 10 is moved to a second position, about ninety degrees counterclockwise from the position of FIG. 3A, here resting on wheels 52, locking member 22 of T-shaped mechanism 12B1 moves (shown by arrow) under it's own weight shown in FIG. 3B. The spools carried in the cage 26 are still secured by the three remaining members 14, 16 and 18, as well as locking members 22, with members 22 now locked in respective locking tracks 75 and 75 of T-shaped mechanisms 12BTl and 12BT2.

A third position is shown in FIG. 3C with the caddy laying on its front side 36. When the caddy 10 is moved to the from the second position, a further ninety degrees counterclockwise, locking members 22 of side 12B remain in locking tracks 75 and 75.

Figure 3D:
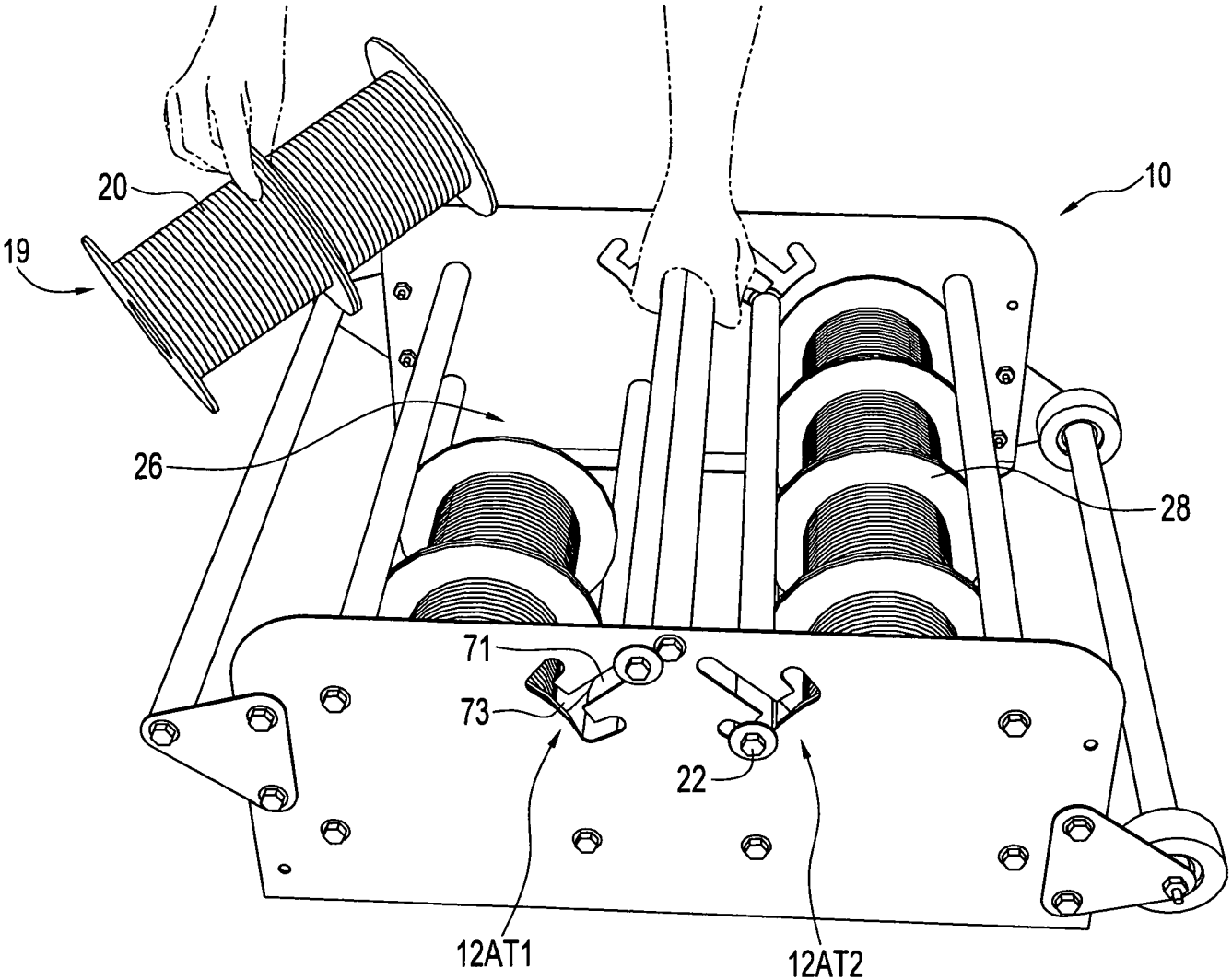
FIG. 3D is a side view of the caddy shown in a release position.

FIG. 3D shows members 22 moved by a user through the central release track 71, thereby creating enough room to remove a spool 20 from a holding cage. This is achieved by a user manually moving locking member 22 to the end of the central release track 71 distal the perpendicular travel slot 73, to create sufficient clearance exceeding the diameter of the spool walls 19 to allow the addition or removal of spools from the caddy cage 26 or 28.

In this manner a mechanism is provided for adding and removing spools and without the need for the springs or hinges of the prior art to retain a moving support member. There are no pins or bolts to lose, the mechanism moves under the force of gravity keep the spools locked within the caddy 10.

Figure 4A:
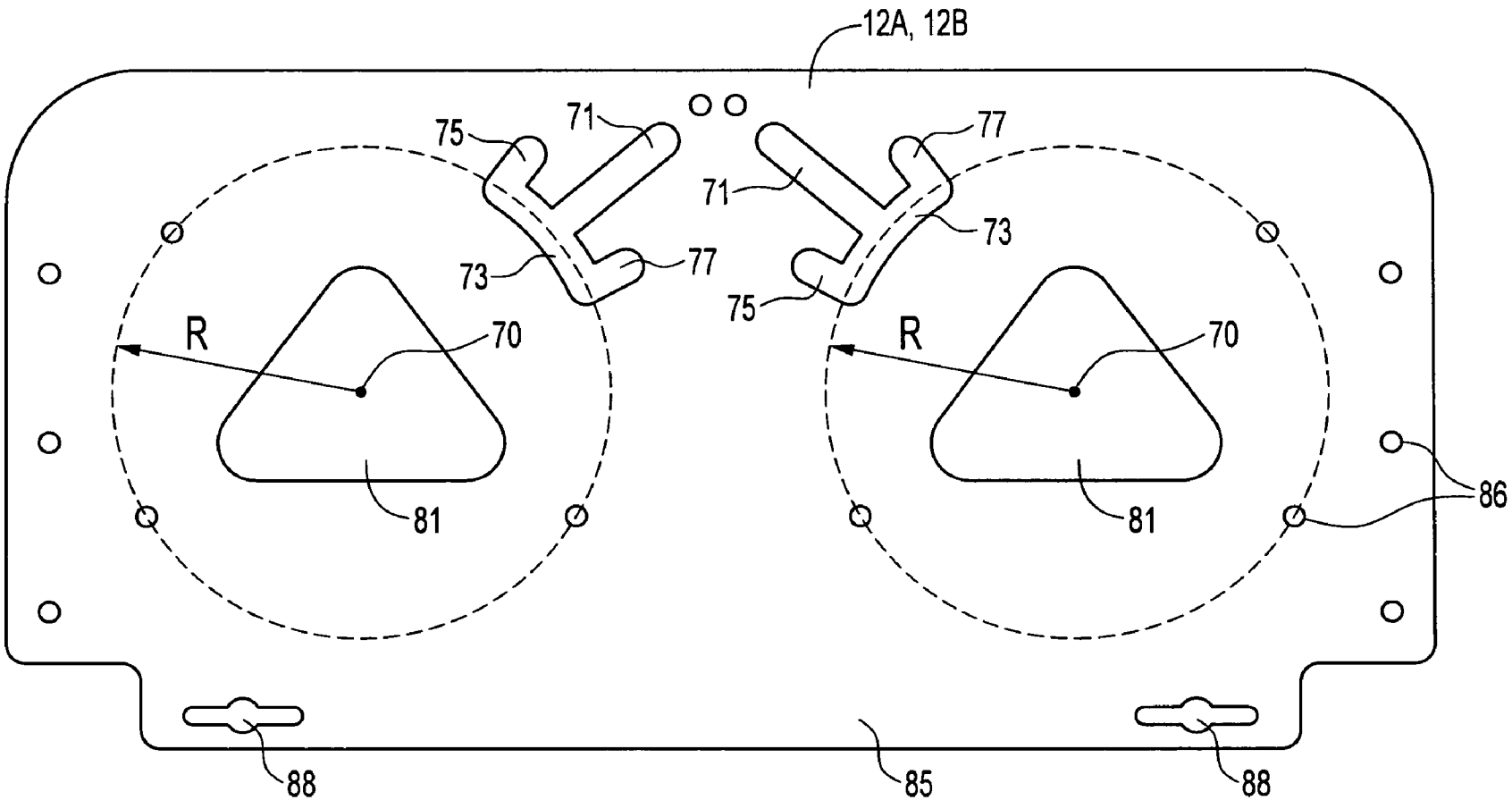
FIG. 4A is a schematic of a side of the spool caddy.
Figure 4B:
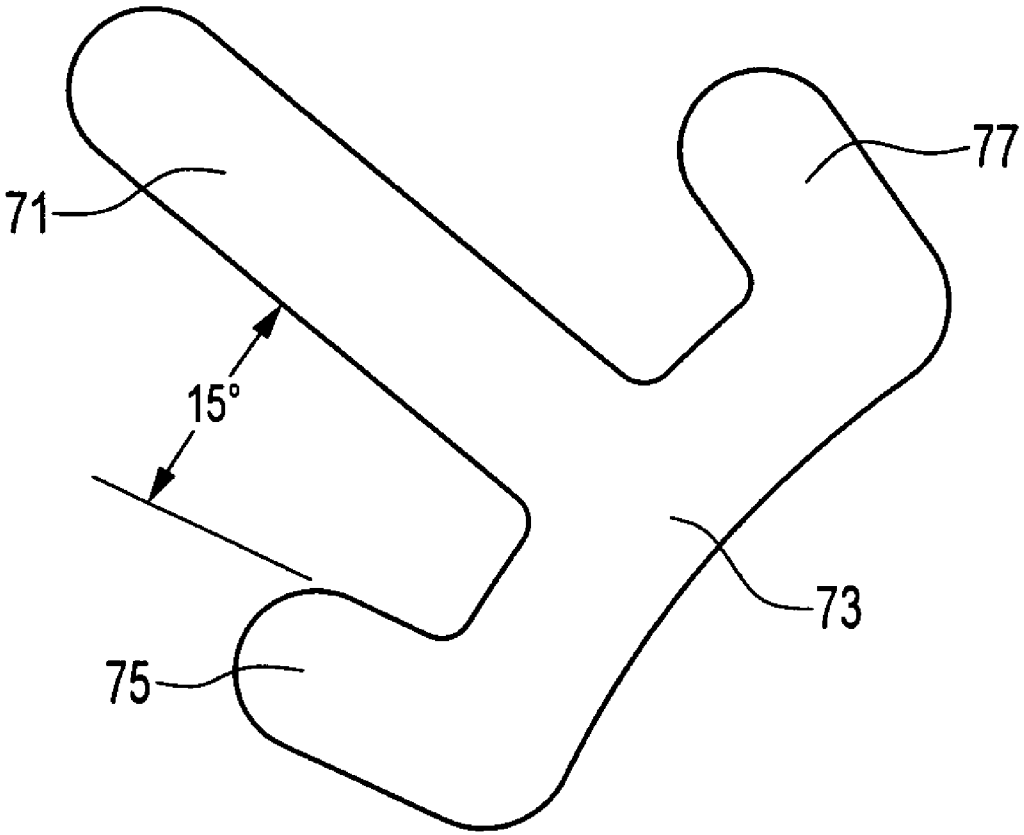
FIG. 4B is a detail view of the locking mechanism shown in FIG. 4A.

FIG. 4A shows a preferred schematic design of an exemplary side wall 12A or 12B of the present invention, showing voids formed in a metal plate during fabrication. FIG. 4B is a detail view of T-shaped locking mechanism. Triangular shapes leaving voids 81 are removed from the side ends, 12A and 12B both to lighten the side walls of the finished product and to provide flanges used to affix offset handle 54 and wheels 52 to each side wall. Note that the radius (shown in dotted lines) formed from the curvature of the perpendicular travel slot 73, the distance from a center point 70 to the travel slot 73 must be sufficiently great to accommodate a spool wall 19 of a given size, yet small enough to secure the spool. The end of the central release track 71 distal the travel slot 73 must be formed at a radius sufficient to allow enough clearance to allow a spool to be withdrawn. It has been found that the locking tracks 77 and 75 are best formed at a fifteen degree angle from the central release track 71 to retain a locking member 22 in the locking track. Voids 86 are also depicted in FIG. 4A, positioned to receive the various members, 14-22 for example.

Figure 5A:
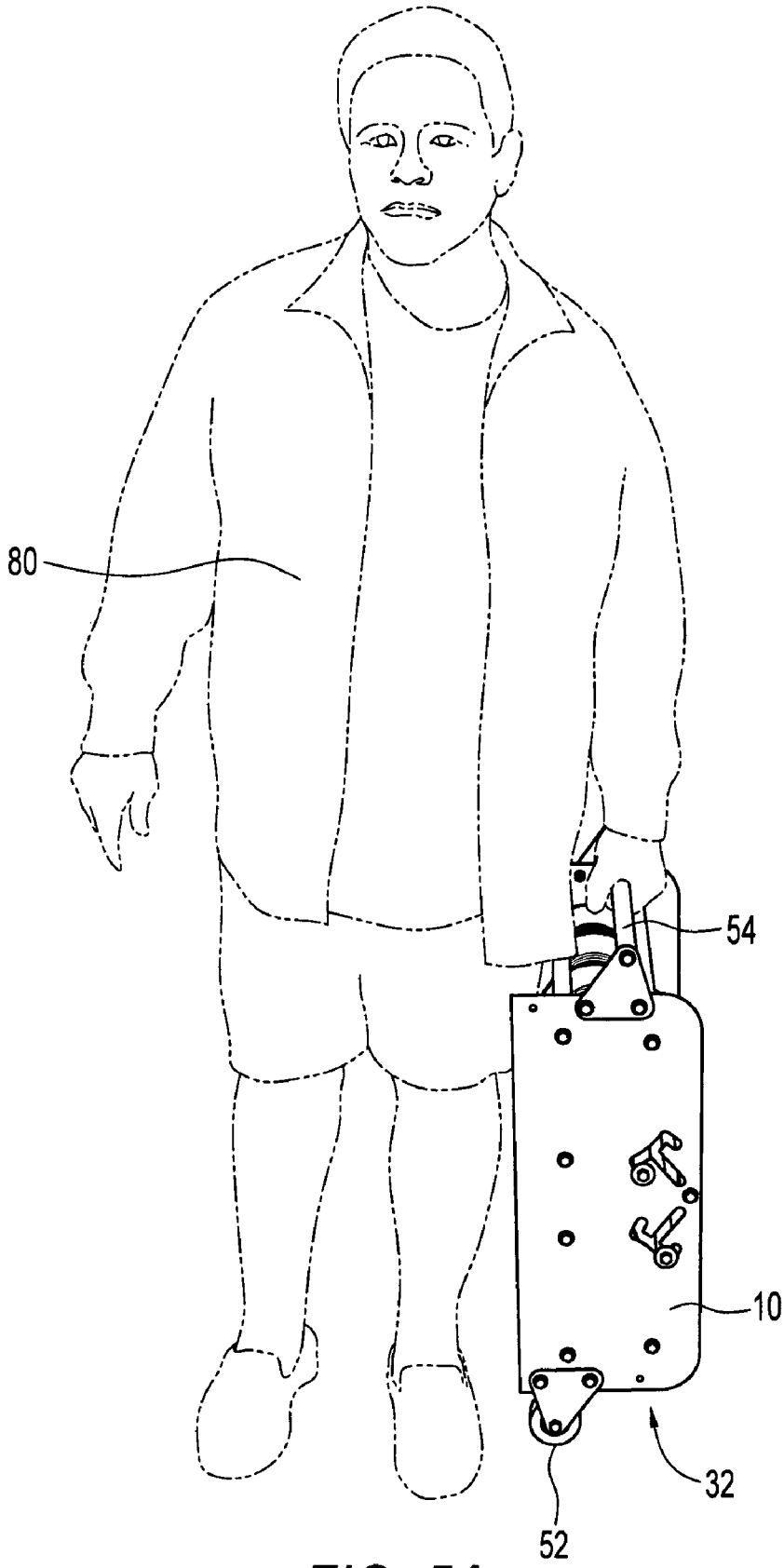
FIG. 5A is a side view of the spool caddy being carried by a user.
Figure 5B:
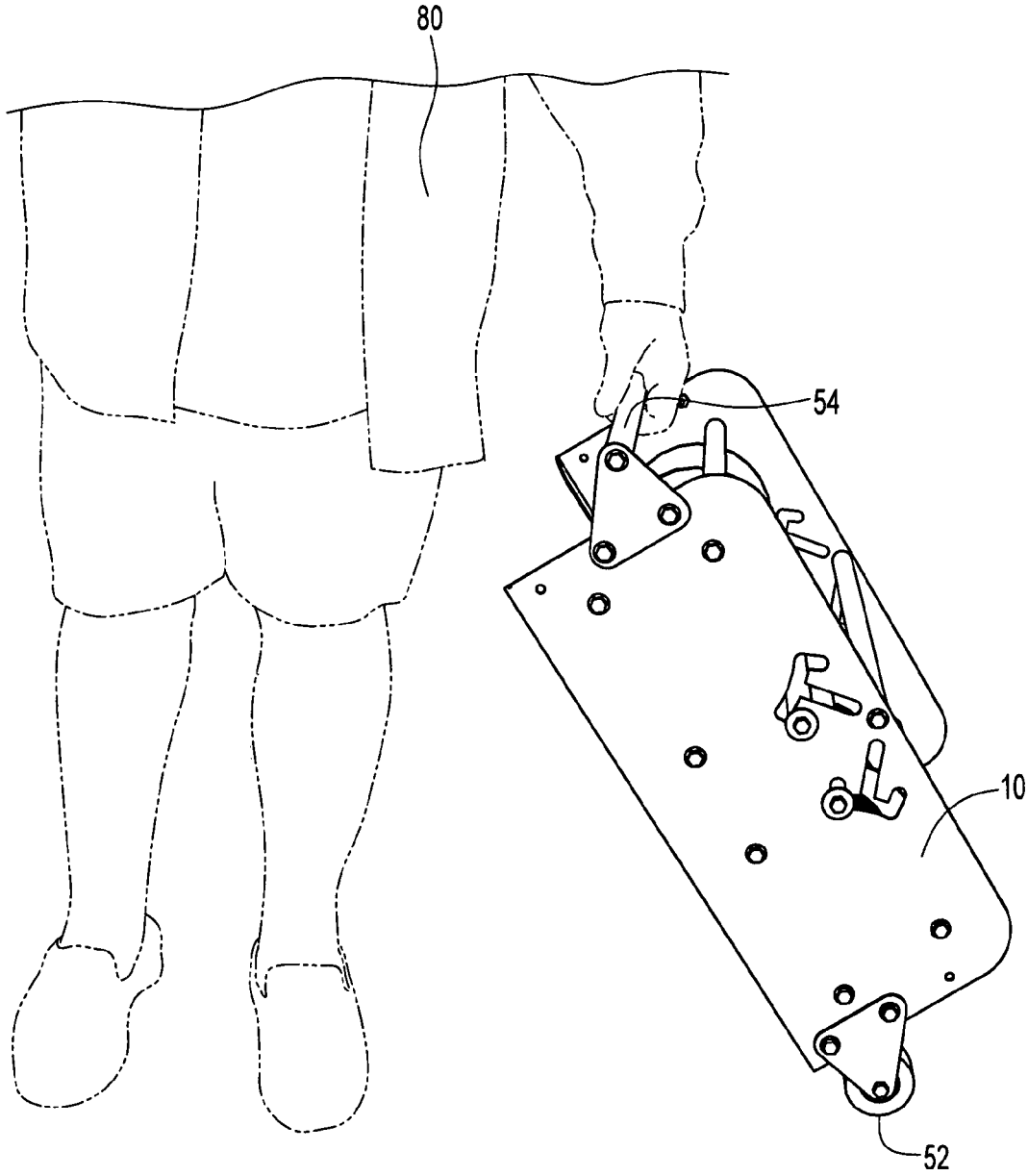
FIG. 5B is a side view of the spool caddy being towed by a user.
Figure 5C:
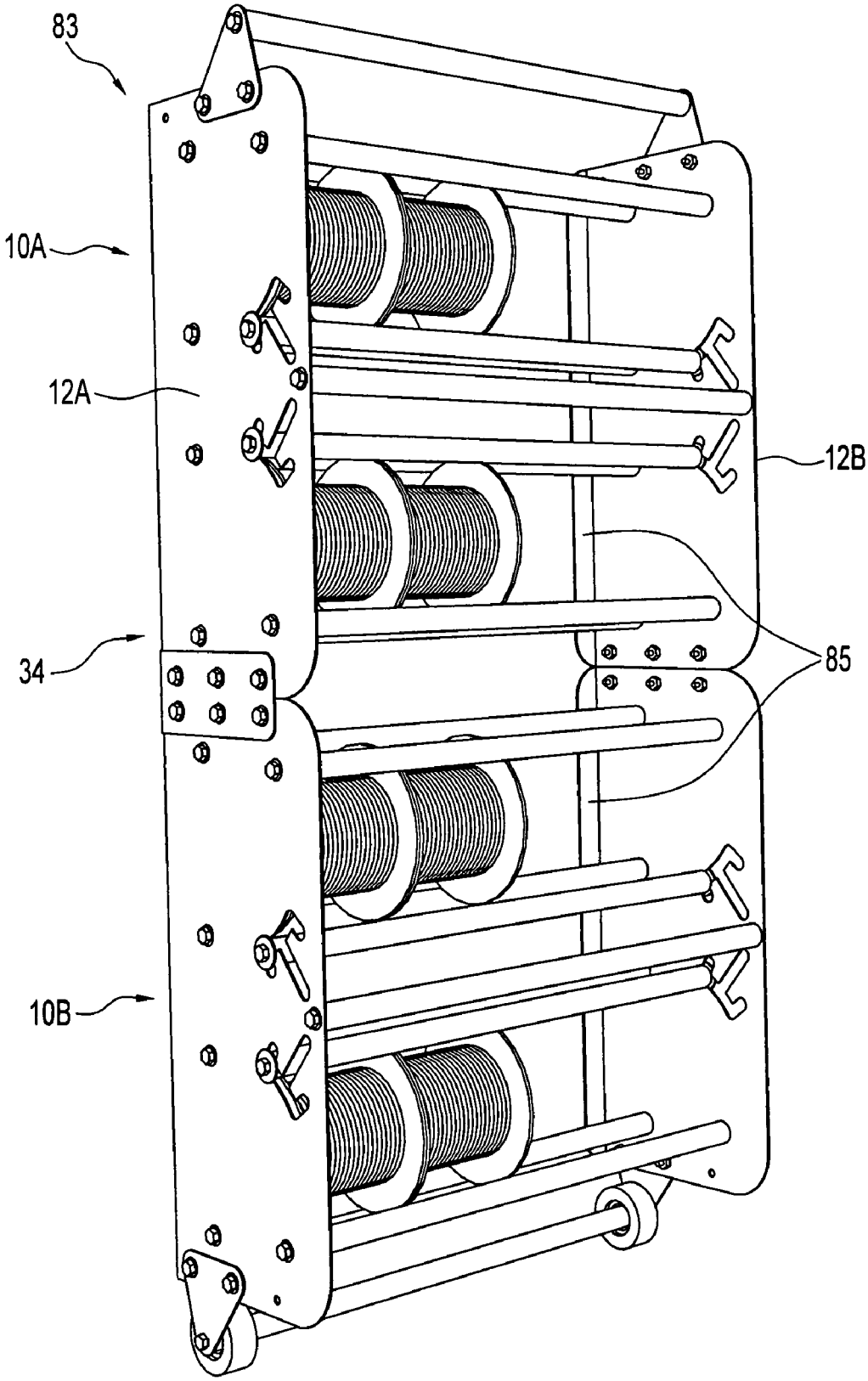
FIG. 5C is a perspective view of an embodiment of the invention where two spool caddies have been affixed to form a single large spool caddy.

FIGS. 5A through 5C show four additional features of the present invention. An offset handle 54 is affixed at the top end 30 of the caddy. This handle 54 is designed to be offset from center and carried away from a user's 80 body (shown in FIG. 5A) so that when carried the center of mass is such that the bottom 32 of the caddy 10 swings away from the user's legs while walking. This offset design can be used with other hand-held luggage as well such as suitcases and the inventor envisions this use as well.

FIG. 5B shows a user 80 towing the caddy 10 as a cart. Wheels 52 are offset as well in this embodiment, placed at the bottom 32 rear 34 of the caddy 10. Two or more caddies, shown as 10A and 10B can also be affixed to create a longer cart, as shown in FIG. 5C.

FIG. 5C also shows the caddy being used as a wire spool shelf, affixed at the rear side 34 to a wall 83. The flange 85 formed on the rear side 34 of each wall 12A and 12B at a ninety-degree angle to each wall 12A and 12B, inwardly towards the opposite wall. Voids 88 formed in the flange 85 allow the unit to be placed on nails or studs in a wall or other vertical surface.

Figure 6A:
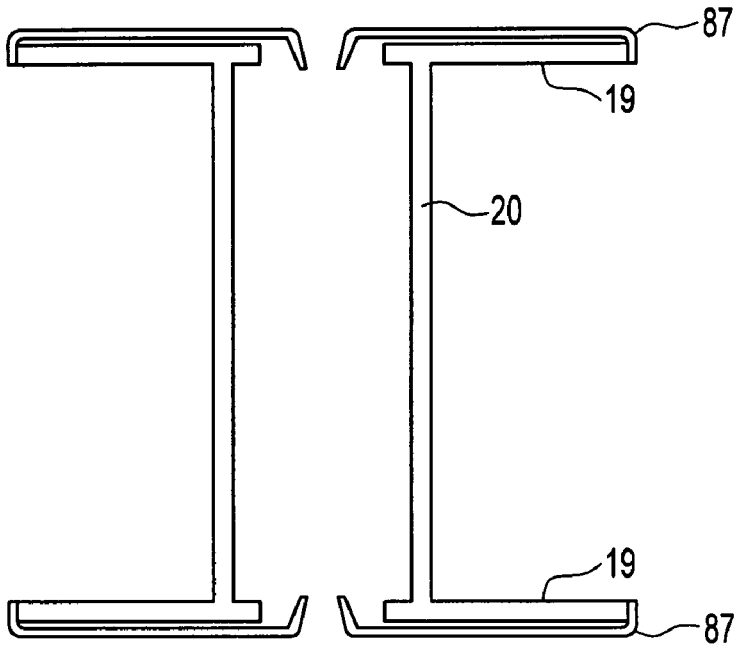
FIG. 6A is a side view of a spool fitted with an end cap.
Figure 6B:
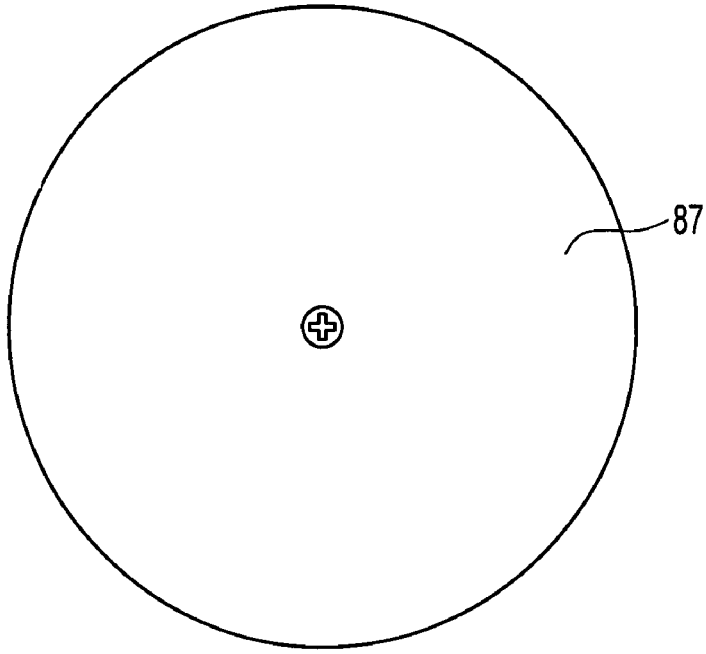
FIG. 6B is an end view of an end cap.

Referring now to FIGS. 6A and 6B, spools 20 used with the present invention may also be equipped with end caps 87 to standardize the diameter of multiple spools of different side 19 diameter or spools with damaged sides 19. This standardization creates and equal distribution of weight of the members 14-22, for example, on the wire spools 20 contained within a holding cage 26 or 28.

It will be appreciated that the invention has been described hereabove with reference to certain examples or preferred embodiments as shown in the drawings. Various additions, deletions, changes and alterations may be made to the above-described embodiments and examples without departing from the intended spirit and scope of this invention. Accordingly, it is intended that all such additions, deletions, changes and alterations be included within the scope of the following claims.

What is claimed is:

1. A caddy for carrying spools, comprising: two opposite side walls held in fixed relation by members and having complementary T-shaped slots formed in each wall, each T-shaped slot comprised of a central release track and a perpendicular travel slot, the members affixed to each side wall are oriented to form a cage to hold one or more spools of similar diameter, at least one of the members is a locking member that moves within the central release tracks and the perpendicular travel slots of the two complementary T-shaped slots, the locking member moves along the perpendicular travel slots under the force of gravity to retain the spools within the cage as the caddy is moved to different orientations to a surface, and when the locking member is moved along the central release tracks away from the perpendicular travel slots sufficient clearance is provided to allow a spool to be added or removed from the cage.

2. The caddy of claim 1 where the perpendicular travel slots have a dog-legged locking track portion, thereby hindering the movement of the locking member when it moves into the dog-legged portion under the force of gravity.

3. The caddy of claim 1 where one or more of the members have tube coverings that roll upon the member, thereby allowing a spool to roll on the covering.

4. The caddy of claim 3 where the tube covering is a plurality of tube covering segments on a member, to allow a plurality of spools to roll independently on the member.

5. The caddy of claim 1 where at least one of the spools is fitted with end caps to make the spool of sufficient diameter to be held within the cage.

6. The caddy of claim 1 where the two opposite side walls have a plurality of cages formed by members according to claim 1, each cage having complementary T-shaped slots.

7. The caddy of claim 1 further comprising a handle affixed at one end of the caddy and wheels affixed at the opposite end of the caddy, thereby allowing the caddy to be used as a cart.

8. The caddy of claim 7 where the handle is offset, thereby allowing the caddy to swing away from a user when towed.

9. The caddy of claim 1 where the caddy is affixed to a wall to be a spool shelf.

10. A method for storing spools of wire, comprising the steps of:

providing a caddy for carrying spools, comprising two opposite side walls held in fixed relation by members and having complementary T-shaped slots formed in each wall, each T-shaped slot comprised of a central release track and a perpendicular travel slot, the members affixed to each side wall are oriented to form a cage to hold one or more spools of similar diameter, at least one of the members is a locking member that moves within the central release tracks and the perpendicular travel slots of the two complementary T-shaped slots, the locking member moves along the perpendicular travel slots under the force of gravity to retain the spools within the cage as the caddy is moved to different orientations to a surface, whereby when the locking member is moved along the central release tracks away from the perpendicular travel slots there is sufficient clearance provided to allow a spool to be added or removed from the cage, and placing a spool within the cage.

11. The method of claim 10 where the perpendicular travel slots have a dog-legged locking track portion, thereby hindering the movement of the locking member when it moves into the dog-legged portion under the force of gravity.

12. The method of claim 10 where one or more of the members have tube coverings that roll upon the member, thereby allowing a spool to roll on the covering.

13. The method of claim 12 where the tube covering is a plurality of tube covering segments on a member, to allow a plurality of spools to roll independently on the member.

14. The method of claim 10 where at least one of the spools is fitted with end caps to make the spool of sufficient diameter to be held within the cage.

15. The method of claim 10 where the two opposite side walls have a plurality of cages formed by members according to claim 1, each cage having complementary T-shaped slots.

16. The method of claim 10 further comprising a handle affixed at one end of the caddy and wheels affixed at the opposite end of the caddy, thereby allowing the caddy to be used as a cart.

17. The method of claim 16 where the handle is offset, thereby allowing the caddy to swing away from a user when towed.

18. The method of claim 10 where the caddy is affixed to a wall to be a spool shelf.

* * * * *